US011037526B2

(12) United States Patent
Facchin et al.

(10) Patent No.: US 11,037,526 B2
(45) Date of Patent: Jun. 15, 2021

(54) AMBIENT LIGHT COLOR COMPENSATION

(71) Applicant: HEWLETT-PACKARD DEVELOPMENT COMPANY, L.P., Spring, TX (US)

(72) Inventors: Natan Facchin, Porto Alegre (BR); Julia Zottis, Porto Alegro (BR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/607,875

(22) PCT Filed: Apr. 24, 2017

(86) PCT No.: PCT/US2017/029178
§ 371 (c)(1),
(2) Date: Oct. 24, 2019

(87) PCT Pub. No.: WO2018/199902
PCT Pub. Date: Nov. 1, 2018

(65) Prior Publication Data
US 2020/0118521 A1 Apr. 16, 2020

(51) Int. Cl.
*G09G 5/04* (2006.01)
*G09G 5/10* (2006.01)

(52) U.S. Cl.
CPC ..... *G09G 5/04* (2013.01); *G09G 5/10* (2013.01); *G09G 2320/0242* (2013.01); *G09G 2340/06* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 6,311,130 | B1 * | 10/2001 | Huang | G06F 17/14 702/15 |
| 8,243,210 | B2 | 8/2012 | Bing et al. | |
| 8,872,814 | B1 * | 10/2014 | Agaian | G06T 15/00 345/419 |
| 9,349,346 | B2 | 5/2016 | Yang et al. | |
| 10,055,551 | B2 * | 8/2018 | Agaian | G06K 9/66 |
| 2007/0139345 | A1 * | 6/2007 | Shie | G09G 3/3648 345/98 |
| 2008/0054159 | A1 * | 3/2008 | Yu | G09G 3/3406 250/205 |

(Continued)

FOREIGN PATENT DOCUMENTS

| | | |
|---|---|---|
| CN | 105118433 | 12/2015 |
| CN | 106293060 | 1/2017 |

OTHER PUBLICATIONS

Automatic Monitor Color Temperature Adjustment, 2014 < https://learn.adafruit.com/automatic-monitor-color-temperature-adjustment?view=all />.

(Continued)

*Primary Examiner* — Patrick N Edouard
*Assistant Examiner* — Peijie Shen
(74) *Attorney, Agent, or Firm* — Michael A. Dryja

(57) ABSTRACT

An apparatus comprising ambient light color compensation circuitry to subtract a color component associated with ambient light from a corresponding color component of image data of an image to be displayed in accordance with a color profile of the ambient light.

12 Claims, 6 Drawing Sheets

(56) References Cited

U.S. PATENT DOCUMENTS

| | | | | |
|---|---|---|---|---|
| 2008/0186707 | A1* | 8/2008 | Ku | H05B 47/105 362/253 |
| 2008/0303918 | A1 | 12/2008 | Keithley | |
| 2010/0092028 | A1* | 4/2010 | Huang | G06K 9/527 382/100 |
| 2011/0199350 | A1* | 8/2011 | Wilson | G09G 5/02 345/207 |
| 2014/0071102 | A1* | 3/2014 | Pieper | G09G 5/026 345/207 |
| 2014/0192076 | A1* | 7/2014 | Tan | G06T 11/001 345/582 |
| 2014/0341481 | A1* | 11/2014 | Panetta | G06T 5/50 382/274 |
| 2014/0361888 | A1* | 12/2014 | Huang | G08B 5/36 340/539.1 |
| 2017/0163901 | A1* | 6/2017 | Lin | G02B 3/0006 |
| 2018/0081877 | A1* | 3/2018 | Bagropoulos | G06K 9/6215 |
| 2019/0191153 | A1* | 6/2019 | Speigle | G09G 5/10 |
| 2020/0022239 | A1* | 1/2020 | Hung | G09G 3/2003 |
| 2020/0037902 | A1* | 2/2020 | De Haan | A61B 5/02416 |
| 2020/0200596 | A1* | 6/2020 | Shepelev | G09G 3/3413 |

OTHER PUBLICATIONS

N.E. Huang et al., A review on Hilbert-Huang transform: Method and its applications to geophysical studies, Jun. 6, 2008, 99, 1-23, paragraphs, (6), (13)-(21), Retrieved from: <http://www.msri.org/people/members/2008cc/Projects/Project_5B_Ice_Core_EMD/HuangWu_EMD_RevGeo_2008.pdf>.

* cited by examiner

AMBIENT LIGHT COLOR COMPENSATION

BACKGROUND

Recent technological trends have resulted in a vast increase in the number and usage patterns of mobile and stationary image displays.

BRIEF DESCRIPTION OF THE DRAWINGS

Disclosed arrangements are further described hereinafter by way of example and with reference to the accompanying drawings, in which.

DETAILED DESCRIPTION

Absent compensation, the appearance of a displayed image can be detrimentally affected by the ambient light of the display environment. Compensating for ambient light facilitates providing an improved image display.

An image display emits light in order to display an image, with the emitted light having properties that vary across the display region in accordance with the image to be displayed. But an image display is typically not the only visible light source at the display location; external light sources such as indoor lighting or the sun dictate ambient light conditions. Ambient light outdoors has a light temperature that is typically warm, whereas the opposite is generally true indoors where there is a source of relatively cold artificial lighting.

Absent compensation to take into account the ambient light, the displayed image is affected by the ambient light. As an example of this effect, a user may view an image displayed on a mobile display indoors and then wander outside only to notice that the displayed image takes on a different appearance owing to the change in ambient light conditions.

Compensating for ambient light when displaying an image can therefore lead to a more consistent viewing experience and a more faithful reproduction of the image. This is of particular importance in the creative industry where, for example, professional photographers are required to work in very different environments but nevertheless desire faithful representations of images.

Furthermore, power might be saved by preventing the emission of light already provided by ambient light.

It is also desirable to provide ambient light compensation that is not only effective at compensating for the effect of ambient light but also efficient to implement, avoiding the addition of any significant delay in displaying an image or employing excessive processing power.

An apparatus is disclosed comprising: ambient light color compensation circuitry to subtract at least one color component associated with ambient light from corresponding color components of the image data of an image to be displayed in accordance with a color profile of the ambient light.

The ambient light may be ambient light at the display location. Thus the color profile may be location specific. Alternatively, the color profile may be generic, characterizing typical ambient light conditions.

As used herein, the term "logic" and/or "circuitry" may refer to, be part of, or include an Application Specific Integrated Circuit (ASIC), an electronic circuit, a processor (shared, dedicated, or group) and/or memory (shared, dedicated, or group) that execute at least one software or firmware instructions and/or program, a combinational logic circuit, and/or other suitable components that provide the described functionality.

Figure 1:
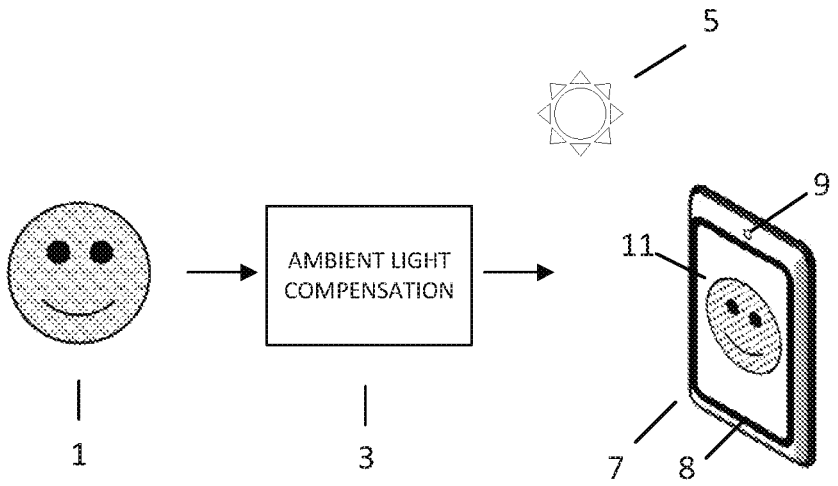
FIG. 1 depicts an example of ambient light compensation.

FIG. 1 depicts an example of ambient light compensation 3. Ambient light compensation 3 is applied to an image 1 to be displayed. In this example, the sun 5 provides a source of ambient light and a device 7 having image sensor 9 and providing display 8 renders the ambient light compensated image 11. By compensating for the ambient light associated with the sun 5, the ambient light compensated image 11 can be more faithfully represented and in a manner that is more consistent across other display environments with alternative sources of ambient light, or more consistent in the same display environment such as in the case of differing levels of intensity of the sun throughout the day.

Figure 2:
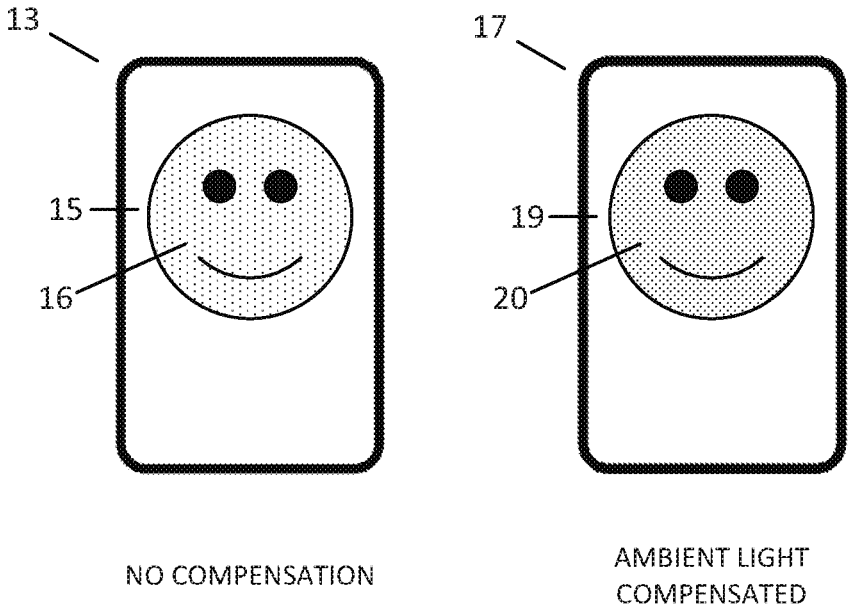
FIG. 2 depicts an example of a displayed image without ambient light compensation and a displayed image with ambient light compensation.

FIG. 2 depicts an example of the effect of ambient light compensation. The left-hand side depicts an example of not compensating for ambient light and the image 1 is shown as image 15 displayed on display 13. The right-hand side depicts an example of ambient light compensation and the image 1 is shown as ambient light compensated image 19 displayed on display 13. The colors 20 of the ambient light compensated image 19 more faithfully reflect those of the original image 1 than the colors 16 of the image 15 without ambient light compensation.

Figure 3:
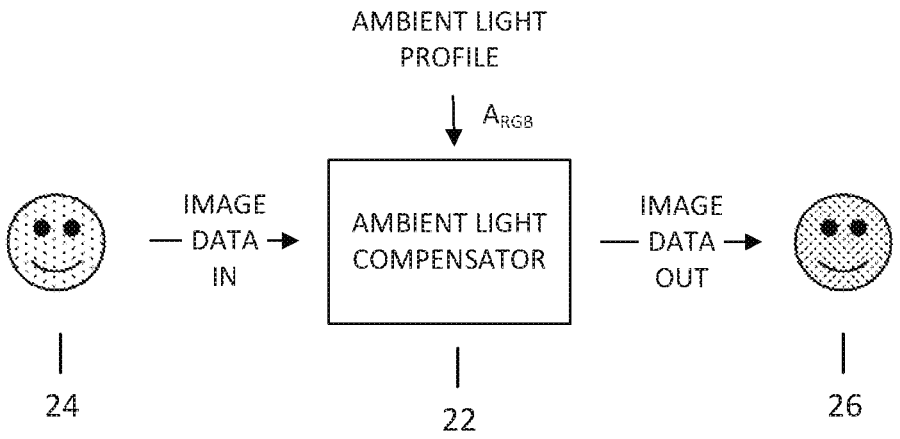
FIG. 3 depicts an example of an ambient light compensator.

FIG. 3 depicts an example of an apparatus comprising an ambient light compensator 22. An image 24 is ambient light compensated by the ambient light compensator 22 to provide an ambient light compensated image 26. The ambient light compensation is applied based on an ambient light profile.

The apparatus may comprise an electronic receiver such as a wired or wireless receiver for receiving an ambient light profile from an external source.

Figure 4:
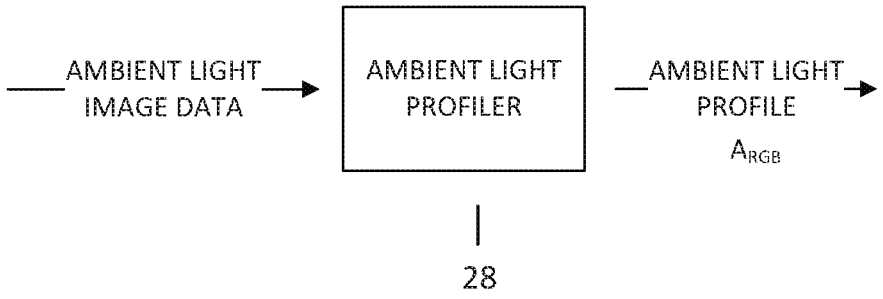
FIG. 4 depicts an example of an ambient light profiler.

FIG. 4 depicts an example of an apparatus comprising an ambient light profiler 28. The ambient light profiler 28 receives ambient light image data representative of ambient light conditions and accordingly generates an ambient light profile that characterizes the ambient light conditions represented by the ambient light image data.

In the examples shown, the ambient light color profile is $A_{RGB}$ representing a vector of RGB color co-ordinates. The ambient light color profile could take other forms. For example, where a different color space is employed the ambient light color profile could comprise color coordinates in that color space. Where the ambient light color profile is provided in the same color space as that of the image to be ambient light color compensated, the requirement to convert between color spaces during compensation is reduced.

The ambient light color profile could be generated in a color space that is different to that of the image to be displayed.

The ambient light color profile could be the color temperature of ambient light. The ambient light color profile could take other forms which characterize the color properties associated with ambient light.

An ambient light profile may be generated using techniques described herein or manually using existing ambient light profiling technology.

Ambient light is location specific and thus the ambient light image data will represent ambient light conditions at the location associated with the ambient light image data.

The ambient light profile may comprise an array of location-specific ambient light sub-profiles associated with ambient light conditions at multiple locations. Thus the ambient light sub-profile may be chosen during ambient light compensation according to the display location. For example, the ambient light compensator 22 could be provided with a location detector to detect the display location. The detected display location could be used to determine the appropriate ambient light sub-profile. In this way ambient light in different locations frequented by a user may be profiled and the overall ambient light color profile comprising location-specific sub-profiles then employed as the user roams about the different locations, obviating the requirement to continually regenerate an ambient light color profile specific to any one given display location.

Each ambient light sub-profile could be associated with an expiry time, with the ambient light sub-profile being regenerated before use following expiry of the expiry time. This would prevent excessive determination of ambient light conditions whilst offering regeneration of ambient light sub-profiles as required to prevent outdated ambient light data being employed during compensation.

Each ambient light sub-profile could additionally or alternatively be associated with a location extent, e.g. a maximum distance over which the ambient light sub-profile is to be used. If the detected display location does not fit within the location extent of any sub-profile, a new sub-profile at the detected display location could be generated and stored in the ambient light sub-profile array. Again this would prevent excessive determination of ambient light conditions whilst offering generation when required.

The ambient light profile (whether or not array of sub-profiles as described above) could be generating using crowdsourcing. In one example, a remote ambient light profiler could be provided that is arranged to receive ambient light image data from at least one client device and generates the ambient light profile based on the received ambient light image data from the one or more client devices. The ambient light image data could be associated with a location and the remote ambient light profiler could thus generate an ambient light profile array of ambient light sub-profiles as described above. This arrangement would facilitate providing cross platform and device consistency in respect of ambient light image compensation at the local client devices.

The ambient light profiler 28 may be employed in order to provide an ambient light profile to be used in the ambient light compensator 22.

Figure 5:
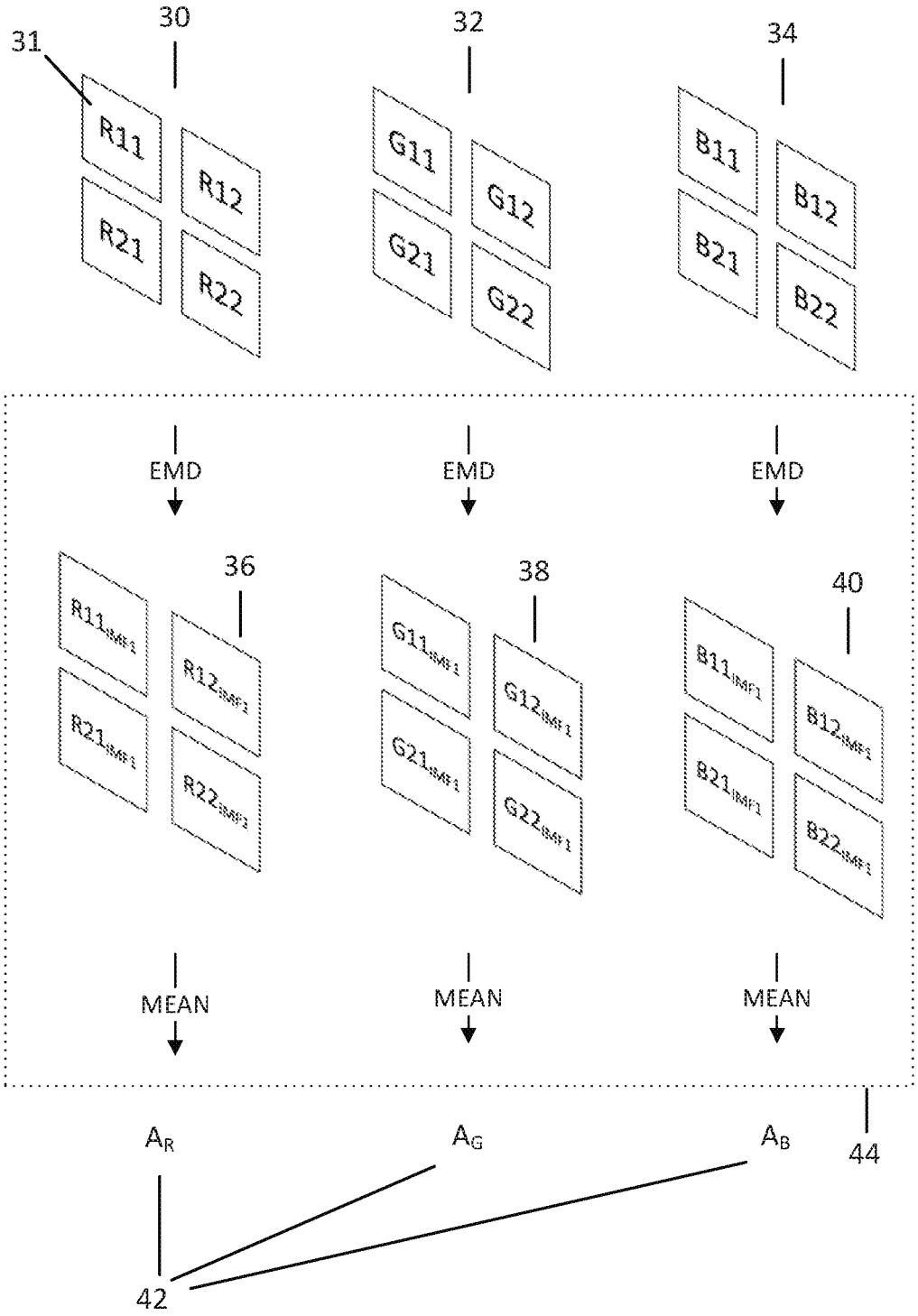
FIG. 5 depicts an example of ambient light profile generation.

FIG. 5 depicts an example of ambient light color profile generation 44.

The Hilbert-Huang transform (HHT) is a signal processing technique to decompose a signal into intrinsic mode functions (IMF) using the empirical mode decomposition (EMD) method. Reference is made to "Huang, N. E., and Z. Wu (2008), A review on Hilbert-Huang transform: Method and its applications to geophysical studies, Rev. Geophys., 46, RG2006, doi:10.1029/2007RG000228", the contents of which are incorporated herein by reference.

The procedure of extracting an IMF is known as sifting. The sifting process comprises the following:

identify the local extrema of the test data connect all the local maxima by a cubic spline as an upper envelope repeat the procedure for the local minima to produce the lower envelope.

The upper and lower envelopes should cover all the data between. The mean may be designated m1 and the difference between the data x and m1 the first component h1:

$$h_1 = x - m_1$$

After the first round of sifting, a crest may become a local maximum. New extrema thus generated reveal the proper modes lost in the initial examination. In the subsequent sifting process, h1 can be treated as a proto-IMF.

Next, h1 is treated as the data in the next iteration:

$$h_1 - m_{11} = h_{11}$$

Following k iterations:

$$h_{1(k-1)} - m_{1k} = h_{1k}$$

Then, h1k is designated as the first IMF component of the data:

$$c_1 = h_{1k}$$

The number of sifting operations may be determined based upon a stoppage criterion, and there are a number of alternative techniques for establishing the stoppage criterion.

One such technique, similar to the Cauchy converge test, is to define a sum of difference, SD, as:

$$SD_k = \sum_{t=0}^{T} \left( \frac{|h_{k-1}(t) - h_k(t)|^2}{h_{k-1}^2(t)} \right)$$

Another is to determine a so-called S-number, the number of consecutive sifting for which the number of zero-crossings and extrema are equal or at most differing by one. An S-number is pre-selected and the sifting process will stop when, for S consecutive siftings, the numbers of zero-crossings and extrema stay the same, and are equal or at most differ by one.

Turning once again to the example of FIG. 5, an ambient light image is provided having red 30, green 32 and blue 34 components, each of which having individual pixel intensity values 31. For simplicity, each component is shown assuming a 2×2 pixel image.

This example is shown for an ambient light image provided in the RGB color space.

The process is equally applicable to other color spaces, e.g. CMYK or HSL.

By determining an ambient light image profile in the same color space as that of the ambient light image data, any color space conversion is obviated.

The process is applicable to any size of image characterizing ambient light. By using a low resolution ambient light image however, processing requirements may be reduced without significant sacrifice of accuracy.

Next, a two-dimensional EMD is applied separately in each axis of the color space thereby to determine a first IMF for the red, green and blue axes of the color space so as to generate a first red axis IMF 36, a second green axis IMF 38 and a third blue axis IMF 40.

In generating the first IMF, the SD stoppage criterion may be used, with a value of between 0.05 and 0.3, e.g. 0.1, 0.15, 0.2 or 0.25. Alternatively, the S-number stoppage criterion may be used having a value of between 3 and 10, e.g. 4, 5, 6, 7 or 8. Other stoppage criteria may be employed.

In one example, first and subsequent IMFs are generated and the ambient light profile generated based on a weighted average of the values of each IMF. In another example, the first IMF is generated and the ambient light profile generated based on the first IMF alone. Whilst ordinarily in effecting the HHT transform the EMD would then continue to be applied to generate second and subsequent IMFs, stopping the EMD process once the first IMF is determined facilitates a reduction in processing requirements without significantly reducing accuracy of ambient light characterization.

Next, for each axis the average value out of the values of the first IMF may be determined to generate the color co-ordinates of the ambient light color profile.

In this case:

$$A_R=(R11_{IMF1}+R12_{IMF1}+R21_{IMF1}+R22_{IMF1})/4;$$

$$A_G=(G11_{IMF1}+G12_{IMF1}+G21_{IMF1}+G22_{IMF1})/4; \text{ and}$$

$$A_B=(B11_{IMF1}+B12_{IMF1}+B21_{IMF1}+B22_{IMF1})/4.$$

Whilst the example shows a first IMF being generated for each axis of the color space, a first IMF could be generated for less than all of the axes of the color space, e.g. only one axis of the color space thereby to generate a color profile. This can lead to a reduction in processing requirements. For example, the process could be employed in respect of the red color component. Thus the contribution of ambient light in the red color component of image data alone could be compensated. As a further example, when the HSL color space is employed, the H component representing hue is most significant in terms of color and thus the remaining S (saturation) and L (lightness) components could be ignored. In this latter case a first IMF would be determined based on the H component, an average of the first IMF values would then be taken to determine an ambient light H co-ordinate forming the ambient light color profile. Alternatively, the first IMF may be determined based on the S or L components.

The ambient light color profile might be generated in a color space that is different to the color space of the image to be displayed and optionally then converted into the same color space of the image to be displayed. That different color space may be the same color space as that of the ambient light image data, or alternatively the ambient light image data might be converted to that different color space. Generating the ambient light color profile in a different color space in this way may facilitate more efficient generation of the ambient light color profile either by preventing the need for conversion of the ambient light image data or because that color space facilitates less intense computation. Taking the HSL example above, first IMFs may be generated in the H axis of the color space and not the S and L axes, and thus by generating the ambient light profile in this color space there is facilitated a reduction in computational expense associated with the ambient light profiling. Converting the color space of the ambient light profile would be computationally inexpensive compared with converting image data to a different color space each time compensation is required, and therefore the optional converting of the ambient light profile to the color space of the display image would further facilitate efficient ambient light color compensation notwithstanding the difference in color space of the initial generation of the ambient light profile.

The ambient light image data could be converted to the color space of the display image prior to generation of the ambient light profile. This would facilitate generating the ambient light profile in the same color space as that of the display image.

A color compensator apparatus as disclosed herein may be provided with a color space detector to detect the color space of the ambient light image data and/or the color space of the display image. Alternatively this information may be known beforehand. The apparatus may be provided with a color space converter to facilitate conversion between different color spaces. Thus, for example, if the color space detector detects that the display image data is in a different color space to that of the ambient light image data, it may convert the ambient light image data or the ambient light profile to the same color space as that of the display image data.

Figure 6:
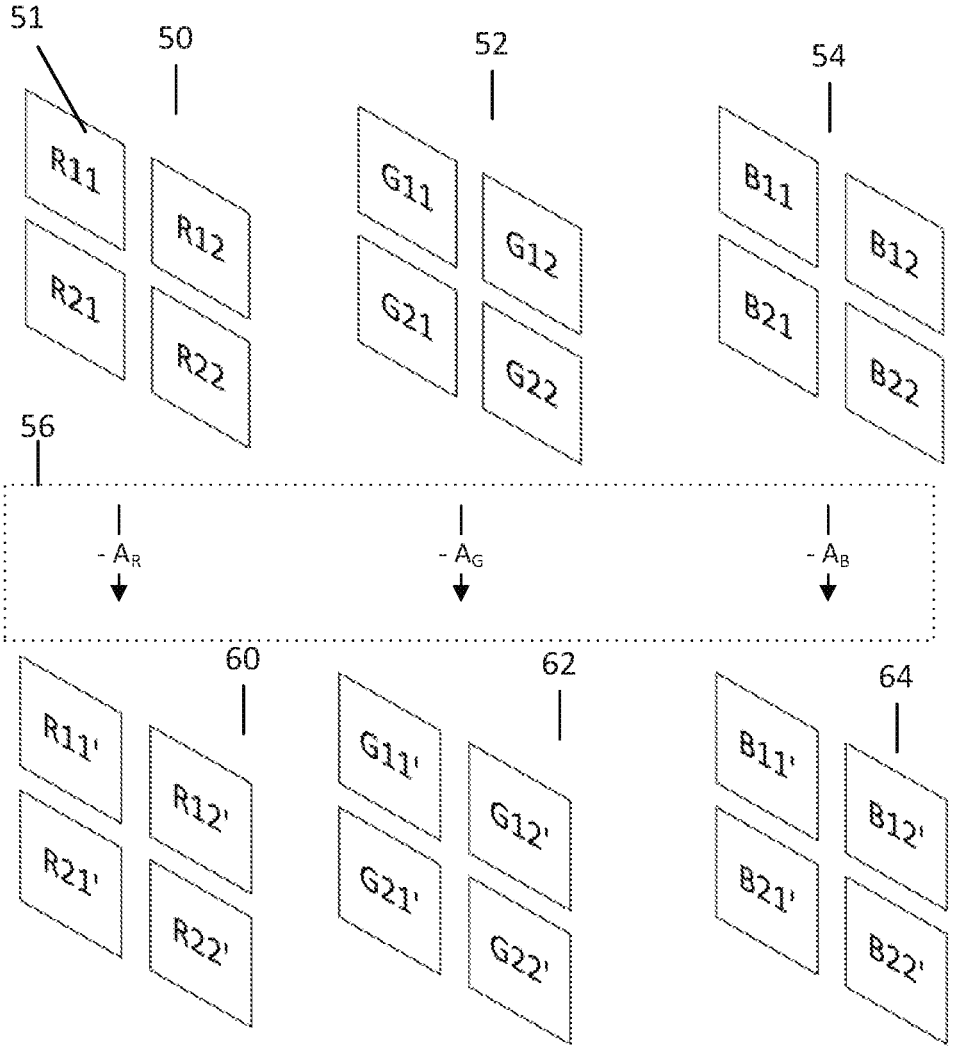
FIG. 6 depicts an example of ambient light compensation applied to an image.

FIG. 6 shows an example of ambient light color compensation 56. As for the case of the ambient light color profile generation shown in FIG. 5, in this example an RGB color space is employed.

An image to be ambient light color compensated has red 50, green 52 and blue 54 components formed by 2×2 pixels 51. The process is applicable to any size of image.

In this example the ambient light image profile having components $A_R$, $A_G$ and $A_B$, one for each color axis of the color space, is employed.

In this example each component of the ambient light profile is subtracted from each of the pixels of the corresponding component of the image to be ambient light color compensated. Each component of the ambient light profile may be weighted for performing the subtraction. The weighting may be based on the proportion of ambient light reflected by the display. Alternatively the weighting may be based on a display reflectivity profile characterizing the reflectivity of the display. By weighting each component of the ambient light profile as part of the subtraction process, factors such as the reflectivity of the display affecting the contribution of the ambient light to the displayed image can be taken into account.

However subtraction to effect ambient light color compensation could be provided in less than all of the axes of the color space of the image data to be displayed, e.g. in only one, two or more axes. Thus where the image data of the display image is in the HSL color space, the H component of the display image data may have the H co-ordinate of the color space profile subtracted therefrom for each pixel, whilst the S and L components of the display image data are left unchanged.

This provides the ambient light color compensated image having red 60, green 62 and blue 64 components.

Whilst the RGB color space is employed in this example, the process is equally applicable to other color spaces.

Providing the ambient light color profile in the same color space as the image to be ambient light color compensated prevents the additional processing requirements associated with converting between color spaces. The subtraction can, however, be performed by converting the ambient light color profile into the color space of the image to be ambient light color compensated prior to performing the subtraction. Alternatively the image to be ambient light color profile compensated could be converted into the color space of the ambient light color profile prior to performing the subtraction.

The subtraction of the ambient light color compensation may follow:

$$Z_{XY}'=Z_{XY}-A_Z,$$

where:

$Z_{XY}$ is the pixel of the image to be ambient light color compensated in relation to which X and Y are the pixel indices of the Z color space axis component of the image;

$A_Z$ is the ambient light color profile color space coordinate in the Z color space axis; and $Z_{XY}'$ is the ambient light color compensated pixel.

Figure 7:
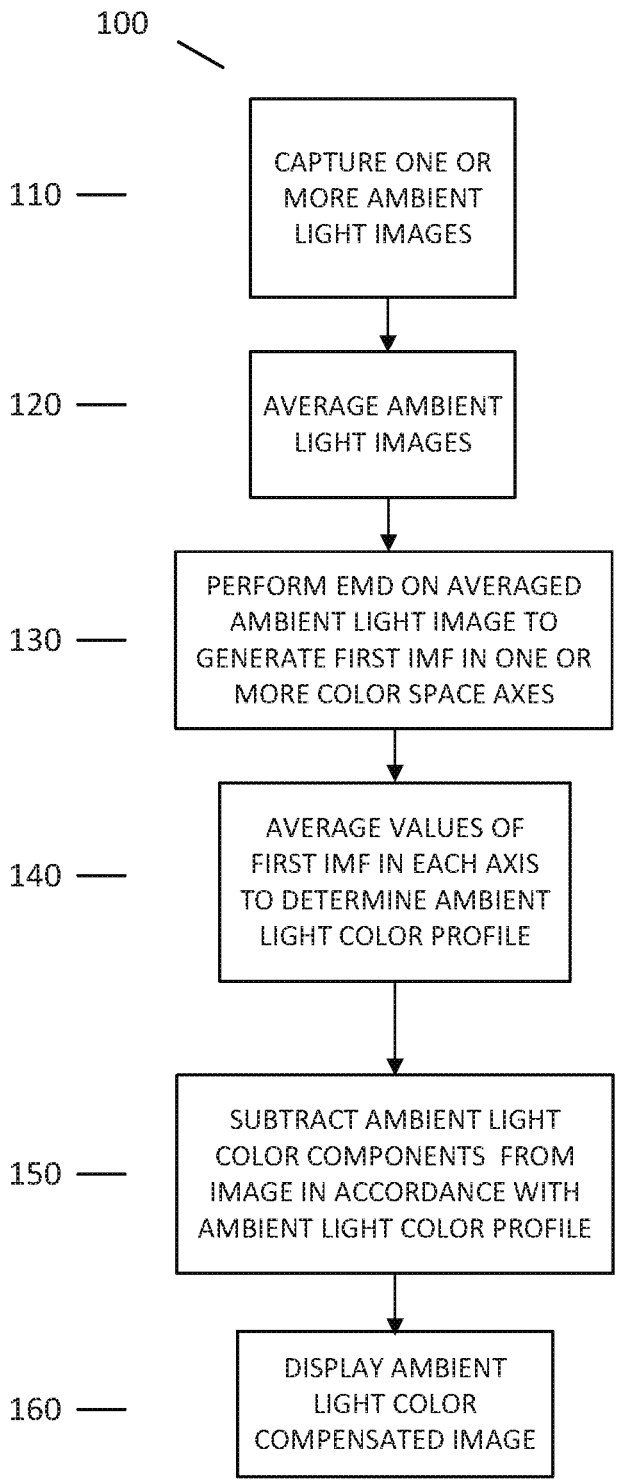
FIG. 7 depicts an example method of ambient light compensation.
Figure 8:
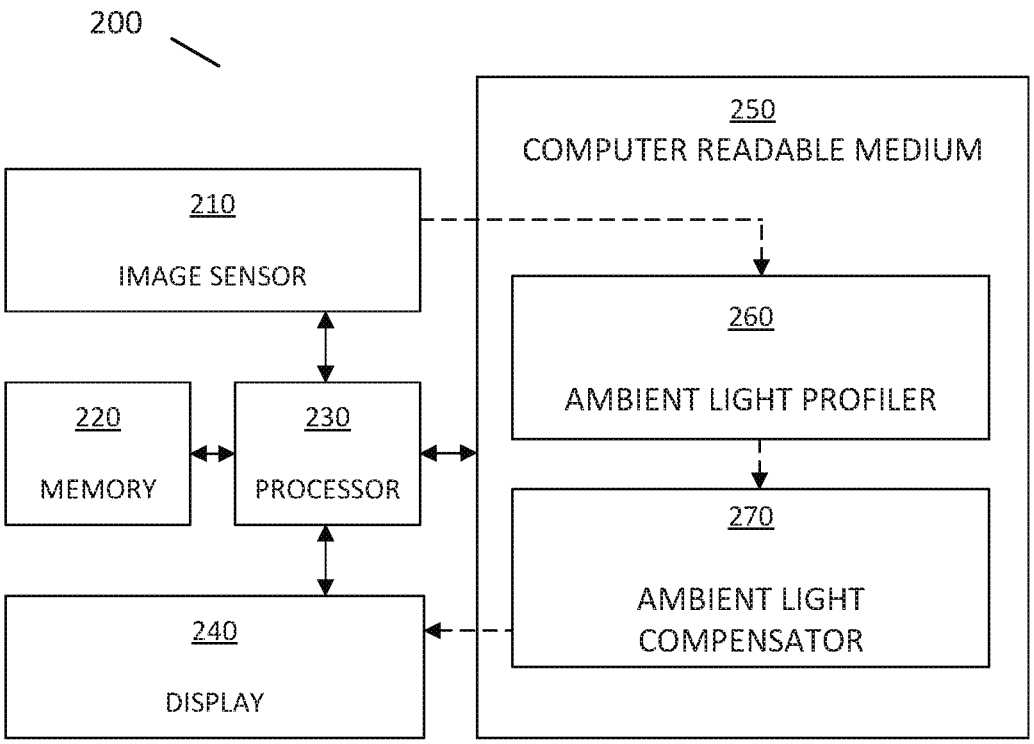
FIG. 8 depicts an example ambient light compensation system.

FIG. 7 depicts an example of a method 100 of ambient light color compensation.

In 110, at least one ambient light image is captured. The capturing of ambient light images may be performed using an image sensor.

In 120, ambient light images are averaged.

By capturing multiple ambient light images and averaging them, it is possible to more accurately characterize ambient light; ambient light fluctuations may be averaged and temporary fluctuations such as those associated with movement or an object such as a users hand appearing in front of the image sensor can be managed. Where one image alone is obtained, no averaging is required.

Thus an apparatus to perform ambient light color compensation as described herein may comprise averaging circuitry. The averaging circuity may average ambient light images thereby to generate the ambient light image data. The averaging may comprise, for each pixel index, determining the mean pixel intensity value. Alternatively a weighted average could be provided. Employing a weighted average would facilitate providing greater weight to more recent ambient light images.

In 130 the empirical mode decomposition is performed on the averaged image, in the case where averaging is employed, to generate a first intrinsic mode function in at least one axis of the color space. The EMD can be terminated once the first IMF(s) have been generated to save on processing requirements.

In 140 the values of the first IMFs are averaged thereby to determine the ambient light color profile. Thus for example if a first IMF is determined for the H component in the HSL color space only, the values of the first IMF for the H component are averaged thereby to determine an ambient light color profile having only an H coordinate.

In 150 the ambient light color profile is used to subtract ambient light color components from the image.

Finally, in 160 the ambient light color compensated image is displayed.

110 to 140 associated with determining the ambient light color profile can be performed separately from 150 and 160 associated with effecting the ambient light color compensation and displaying the ambient light color compensated image. The same applies in respect of compensating 150 and displaying 160.

Thus for example a system could be provided comprising: an ambient light color profiler to determine an ambient light color profile, and at least one ambient light color compensator to effect ambient light color compensation in accordance with that ambient light color profile. The ambient light color compensators could be provided with receivers for receiving the ambient light color profile generated by the ambient light color profiler. The ambient light profilers could be provided with a transmitter for transmitting the ambient light color profile. In the case of multiple ambient light color compensators this would enable a more consistent ambient light color compensation across multiple devices to be performed. This could be useful when it is desired for multiple users to see an image that is consistent across multiple devices in the same room, for example.

The ambient light color compensation could be performed in a graphics processing unit (GPU) and/or as part of JPEG decompression. By implementing the ambient light color compensation as part of a GPU and/or as part of JPEG decompression, there is an efficiency gain. In the case of the GPU, it is fast and typically performs operations in parallel, and given the existing capability in respect of reading and writing pixels to memory and other pixel handling operations, implementing the additional ambient light color compensation in the GPU would require minimal additional processing. In the case of JPEG decompression, particularly where this is implemented in the GPU, there is already a requirement to iterate through the pixels through the entire picture, and given the existing operations associated with JPEG decompression then there would be minimal additional processing to perform the ambient light color compensation described herein.

The ambient light color compensation could alternatively be provided in respect of the entirety of the display of an image display. This would facilitate ambient light color compensation for not only an image such as a picture to be displayed, but also the surrounding context such as an apps listing or other user interface elements such as date and time.

The ambient light color compensation may be provided as part of a system comprising a projection apparatus, with the ambient light color compensation being effected with respect to the image to be projected by the projection apparatus. Color compensation in this context facilitates improvement in the faithfulness of reproduction and also power saving associated with not projecting light already provided by ambient light.

FIG. 7 depicts an example of an apparatus 200 for performing ambient light color compensation. A processor 230 controls an image sensor 210 that may be employed to capture image data representative of ambient light conditions.

A computer readable medium 250 may provide code that when executed by the processor 230 can provide an ambient light profiler 260 and/or an ambient light compensator 270, both of which providing the ambient light profiling or compensation described herein.

The following paragraphs disclose further examples forming part of the disclosure.

An apparatus comprising: ambient light color compensation circuitry to subtract at least one color component associated with ambient light from corresponding color components of the image data of an image to be displayed in accordance with a color profile of the ambient light. The at least one color component may be one color component. The at least one color component may be multiple color components. The at least one color component may be each color component in the color space of the image data.

The apparatus according to any of the examples described herein, wherein the ambient light color compensation circuitry is to: generate a first intrinsic mode function (IMF) by performing an empirical mode decomposition (EMD) on ambient light image data representative of ambient light conditions; and generate the ambient light color profile based on the first IMF.

The apparatus according to any of the examples described herein, wherein: the color profile comprises at least one ambient light color coordinate in the color space of the image data of the image to be displayed.

The apparatus according to any of the examples described herein, wherein: the ambient light image data is in the same color space as that of the image data of the image to be displayed; and the ambient light color compensation circuitry is to generate a first IMF for at least one axis of the color space. The at least one axis of the color space may be each axis of the color space.

The apparatus according to any of the examples described herein, wherein: the values of the first IMF for each axis are averaged thereby to determine the at least one ambient light color coordinate.

The apparatus according to any of the examples described herein, wherein the ambient light compensation circuitry is to: terminate the EMD upon generation of the first IMF.

The apparatus according to any of the examples described herein, wherein the ambient light compensation circuitry is to: generate the ambient light image data by averaging image data from multiple images representative of the ambient light conditions.

The apparatus according to any of the examples described herein, comprising: an image sensor to generate image data representative of the ambient light conditions.

The apparatus according to any of the examples described herein, comprising: a display to display the ambient light color compensated image.

A method comprising: generating a first intrinsic mode function (IMF) by performing an empirical mode decomposition (EMD) on ambient light image data representative of ambient light conditions; and generating an ambient light color profile based on the first IMF.

The method according to any of the examples described herein, comprising: generating a first IMF for at least one axis of the color space of the ambient light image data; determining at least one color coordinate to form the ambient light color profile based on the generated first IMF for each axis. The at least one axis and at least one color coordinate may be each axis of the color space of the ambient light image data and a color coordinate for each axis.

The method according to any of the examples described herein, comprising: averaging the values of the first IMF for each axis thereby to generate the color coordinates for that axis.

The method according to any of the examples described herein, comprising: capturing the ambient light image data using an image sensor.

The method according to any of the examples described herein, comprising: subtracting color components associated with ambient light from image data of an image to be displayed; displaying the ambient light color compensated image.

Machine-readable instructions provided on at least one machine-readable medium, the instructions to cause processing circuitry to: generate a first intrinsic mode function (IMF) by performing an empirical mode decomposition (EMD) on ambient light image data representative of ambient light conditions at a location where an image is to be displayed; and generate an ambient light color profile based on the first IMF.

Methods described herein may be implemented using at least one processor. Instructions for causing the at least one processor to carry out the methods may be stored on computer readable medium (such as memory, optical storage medium, RAM, ROM, ASIC, FLASH memory, etc.) The medium may be transitory (e.g. a transmission medium) or non-transitory (a storage medium).

Throughout the description and claims of this specification, the words "comprise" and "contain" and variations of them mean "including but not limited to", and they are not intended to (and do not) exclude other components, integers or operations. Throughout the description and claims of this specification, the singular encompasses the plural unless the context demands otherwise. In particular, where the indefinite article is used, the specification is to be understood as contemplating plurality as well as singularity, unless the context demands otherwise.

Features, integers or characteristics described in conjunction with a particular aspect or example are to be understood to be applicable to any other aspect or example described herein unless incompatible therewith. All of the features disclosed in this specification (including any accompanying claims, abstract and drawings), and/or all of the elements of any method or process so disclosed, may be combined in any combination, except combinations where at least some of such features and/or operations are mutually exclusive. Implementations are not restricted to the details of any foregoing examples.

The invention claimed is:

1. An apparatus comprising:

a processor; and a memory storing instructions executable by the processor to:

generate a first intrinsic mode function (IMF) by performing an empirical mode decomposition (EMD) on ambient light image data representative of ambient light conditions;

generate an ambient light color profile based on the first IMF, the ambient light color profile comprising an ambient light color coordinate in a color space of image data of an image to be displayed; and color compensate for ambient light within the image to be displayed by subtracting a color component associated with the ambient light that is based on the generated ambient light color profile from a corresponding color component of the image data of the image to be displayed; and cause the ambient light color compensated image to be displayed.

2. The apparatus according to claim 1, wherein:

the ambient light image data is in the same color space as that of the image data of the image to be displayed; and the instructions are executable by the processor to generate a first IMF for an axis of the color space.

3. The apparatus according to claim 2, wherein:

the values of the first IMF are averaged thereby to determine the ambient light color coordinate.

4. The apparatus according to claim 1, wherein the instructions are executable by the processor to further:

terminate the EMD upon generation of the first IMF.

5. The apparatus according to claim 1, wherein the instructions are executable by the processor to further:

generate the ambient light image data by averaging image data from multiple images representative of the ambient light conditions.

6. The apparatus according to claim 1, further comprising:

an image sensor to generate image data representative of the ambient light conditions.

7. The apparatus according to claim 6, further comprising:

a display to display the ambient light color compensated image.

8. A method comprising:

generating, by a processor, a first intrinsic mode function (IMF) by performing an empirical mode decomposition (EMD) on ambient light image data representative of ambient light conditions;

generating, by the processor, an ambient light color profile based on the first IMF, the ambient light color profile comprising an ambient light color coordinate in a color space of image data of an image to be displayed;

color compensating, by the processor, for ambient light within the image to be displayed by subtracting, a color component associated with the ambient light that is based on the generated ambient light color profile from the image data of the image to be displayed; and displaying, by the processor, the ambient light color compensated image.

9. The method of claim 8, further comprising:

generating, by the processor, a first IMF for an axis of the color space of the ambient light image data; and determining, by the processor, a color coordinate to form the ambient light color profile based on the generated first IMF.

10. The method according to claim 9, further comprising:

averaging, by the processor, the values of the first IMF thereby to generate the color coordinate.

11. The method according to claim 8, further comprising:

capturing the ambient light image data using an image sensor.

12. A non-transitory computer-readable data storage medium storing machine-readable instructions executable by a processor to:

generate a first intrinsic mode function (IMF) by performing an empirical mode decomposition (EMD) on ambient light image data representative of ambient light conditions at a location where an image is to be displayed;

generate an ambient light color profile based on the first IMF, the ambient light color profile comprising an ambient light color coordinate in a color space of image data of an image to be displayed;

color compensate for ambient light within the image to be displayed by subtracting a color component associated with the ambient light that is based on the generated ambient light color profile from a corresponding color component of the image data of the image to be displayed; and display the ambient light color compensated image.

* * * * *